United States Patent [19]

Lemper

[11] Patent Number: 4,660,616

[45] Date of Patent: Apr. 28, 1987

[54] STARTER BAR APPARATUS IN A CONTINUOUS CASTING ASSEMBLY

[75] Inventor: Herbert Lemper, McMurray, Pa.

[73] Assignee: Kabushiki Kaisha Kobe Seiko Sho, Kobe, Japan

[21] Appl. No.: 833,109

[22] Filed: Feb. 26, 1986

[51] Int. Cl.[4] ..... B22D 11/08

[52] U.S. Cl. ..... 164/426; 164/446

[58] Field of Search ..... 164/446, 445, 426, 425, 164/483

[56] References Cited

U.S. PATENT DOCUMENTS

| | | | |
|---|---|---|---|
| 3,262,162 | 7/1966 | Lemper | 164/446 |
| 3,268,956 | 8/1966 | Lemper | 164/444 X |
| 3,278,999 | 10/1966 | Lemper | 164/440 X |
| 3,318,368 | 5/1967 | Lemper | 164/448 |
| 3,442,145 | 5/1969 | Lemper | 74/54 |
| 3,442,322 | 5/1969 | Lemper | 164/445 |
| 3,453,914 | 6/1969 | Lemper et al. | 83/881 |
| 3,542,117 | 11/1970 | Lemper et al. | 164/154 |
| 3,559,441 | 2/1971 | Lemper et al. | 72/239 |
| 3,585,831 | 6/1971 | Lemper | 72/239 |
| 3,670,587 | 6/1972 | Lemper | 72/239 |
| 3,680,400 | 8/1972 | Lemper et al. | 74/89.15 |
| 3,739,618 | 6/1973 | Lemper | 72/239 |
| 3,765,210 | 10/1973 | Lemper | 72/164 |
| 3,889,740 | 6/1975 | Tarmann et al. | 164/426 |
| 4,150,710 | 4/1979 | John | 164/483 |
| 4,412,579 | 11/1983 | Závodszky | 164/446 X |
| 4,478,271 | 10/1984 | Navarro et al. | 164/446 X |

FOREIGN PATENT DOCUMENTS

| | | | |
|---|---|---|---|
| 0029820 | 6/1981 | European Pat. Off. | 164/445 |
| 0066550 | 12/1982 | European Pat. Off. | 164/426 |
| 2710622 | 9/1978 | Fed. Rep. of Germany | 164/426 |
| 47-37816 | 9/1972 | Japan | 164/445 |
| 55-139153 | 10/1980 | Japan | 164/425 |
| 58-6760 | 1/1983 | Japan | 164/426 |

*Primary Examiner*—Nicholas P. Godici
*Assistant Examiner*—J. Reed Batten, Jr.
*Attorney, Agent, or Firm*—Oblon, Fisher, Spivak, McClelland & Maier

[57] ABSTRACT

A starter bar has a starter bar head attached to a rear end portion thereof, the plate type starter bar being formed by a relatively thin plate. A starter bar handling device for effecting storage and charging of the plate type starter bar for clamping and swinging portions of the starter bar.

2 Claims, 11 Drawing Figures

STARTER BAR APPARATUS IN A CONTINUOUS CASTING ASSEMBLY

BACKGROUND OF THE INVENTION

1. Field of the Invention

The present invention relates to a starter bar apparatus in a continuous casting assembly.

2. Description of the Prior Art

As a conventional starter bar in a continuous casting assembly there is known a starter bar of a link structure in which inside and outside links are connected through a pin and a starter bar head is attached to one end portion, while a tail link is attached to an opposite end portion, as is disclosed in, for example, U.S. Pat. Nos. 4,457,353 and 4,478,271. In this link structure, oil is fed to the pin connection, but problems occur such as deformation of the pin and wear of a bushing and thus frequent repair is needed. Moreover, the operation stability is poor because the movement of the starter bar head is not constant during drawing-out of a cast strip due to the motion of the links. Further, because of the very heavy weight of the starter bar, replacement is difficult and the resultant cost is high.

On the other hand, where a starter bar is to be stowed using a storage table or an inclined table in a continuous casting assembly having the starter bar of a link structure, it is necessary that a cutter front table between a drawing roll unit and a cutter should have a length corresponding to the length of the starter bar. This causes a problem in performing high temperature casting.

SUMMARY OF THE INVENTION

It is a first object of the present invention to provide a starter bar apparatus which is substantially maintenance-free, light in weight, easy to change, inexpensive and which provides constant speed of the starter bar head.

It is a second object of the present invention to provide a starter bar apparatus suitable for high temperature casting.

It is a third object of the present invention to provide a starter bar apparatus which dispenses with the transfer operation, permits a high working efficiency and is free of danger.

A starter bar apparatus in continuous casting assembly according to a first invention for achieving the above first object is characterized by including a starter bar with a starter bar head attached to its rear end portion thereof, the starter bar being formed by a relatively thin plate.

A starter bar apparatus in a continuous casting assembly according to a second invention for achieving the above second object is characterized by including a starter bar with a starter bar head attached to a rear end portion thereof, the starter bar consists of a relatively thin plate and a starter bar handling device, the starter bar handling device having a first arm for clamping a fore end portion of the starter bar when drawn out from a roll unit and swinging it upward at a predetermined radius of curvature in synchronism with the casting speed and a second arm for clamping a rear end portion of the starter bar.

A starter bar apparatus in a continuous casting assembly according to a third invention for achieving the above third object is characterized by including a starter bar with a starter bar head attached to a rear end portion thereof, the starter bar including a relatively thin plate, a starter bar charging car, the starter bar charging car having a first arm for clamping a fore end portion of the starter bar when drawn out from a roll unit and swinging it upward at a predetermined radius of curvature in synchronism with the casting speed and a second arm for clamping a rear end portion of the starter bar; and a lift device for moving the starter bar charging car vertically between a receiving position and a casting floor position. The charging car is controlled so that after being raised to the casting floor position by the lift device, the charging car moves to the mold location, whereupon the fore end portion of the starter bar is unclamped from the first arm, and then the starter bar is charged into a mold by a swinging motion of the second arm.

According to the first invention, since the starter bar is constituted by a relatively thin plate except the connection with the starter head, there is no fear of deformation of the link pin or wear of the bushing, and a maintenance-free structure is attained. Moreover, in the absence of a link motion, the movement of the starter head becomes constant and the withdrawal operation is stabilized, thus improving the operation stability. Further, since the starter bar is a relatively thin plate, it is light in weight and replacement is easy, leading to reduction of cost.

According to the second invention, the torch approach table may be short because of provision of the starter bar handling device for clamping the fore end portion of the starter bar with the first arm and clamping the rear end portion of the same bar with the second arm, and thus the invention is suitable for high temperature casting. Moreover, since the starter bar is merely swung by the first arm, it becomes unnecessary to guide it to the storage position.

According to the third invention, the starter bar as clamped by the first and second arms is raised together with the charging car from the storage position up to the casting floor position by means of the lift device, then moved to the mold location and then charged into the mold by a swinging motion of the second arm. Therefore the starter bar transferring operation is no longer needed, working efficiency is improved and safe operation is ensured. Further, it is not necessary to provide a guide, a chain or the like on the charging car because the starter bar is clamped by the first and second arms of the charging car forming a free standing loop which requires no support.

The starter bar in accordance with the present invention is designed to carry the starter bar head into the mold to provide a bottom in the mold at the beginning of a cast. The starter bar head is of the claw type design which permits highest pulling forces while readily disconnected when desired. The starter bar disconnecting device is foundation mounted and located just ahead of the first roller of the torch approach table.

The jaw-like top of the starter bar head is lifted out of the cast-on strand by a hydraulic cylinder elevating the disconnect roller. The head may be supplied in two widths and is also adjustable to intermediate widths by using width adjusting plates or spacers. The heads are recommended to be steel castings.

The head adaptors attach to the head with wrist pins, that permit attachment and removal of the head from the adaptors by rotating one or the other by 90°. The other end of the adaptors is equipped with a keyway which permits the attachment to the starter bar plate. The plate type starter bar is characterized by being the least costly of all possible slab caster starter bar designs previously known.

Driving forces from maindrives are transmitted to the plate type starter bar by the use of driven pinch rolls which are hydraulically forced together against the starter bar plate. Pinch rolls are opened individually and retracted to be in line with all other inside radius rolls when the head adaptors and the head of the starter bar pass by. Pinch rolls remain in their retracted position until the next starter bar cycle. When the starter bar tail end leaves the last segment it enters the rotating arms of the starter bar charging car. Both arm clamps are open, when the bar has passed through a first arm, an adjacent second arm will clamp the tail end of the bar. The second arm will then begin rotating to withdraw the starter bar at the casting speed. After the second arm has rotated 180 degrees, the head adaptor has entered the first arm and is clamped.

The starter bar disconnect roller lifts the claw type head out of the slab end while the rotating cylinders of the rotating and lifting frame are energized to rapidly remove the head from the slab end to avoid any possibility of reconnection. The rotating frame completes its rotation of 90 degrees to place the starter bar charging car in horizontal position. This position can also be the park position in which the starter bar head is serviced for the next cast.

After the end of the cast, i.e., after the tundish car has cleared the casting position, the starter bar charging car travels toward the mold to feed the starter bar tail first into the mold. When the car has stopped in the charging position, the clamps of the second arm are opened, and the first arm is rotated toward the second arm.

The starter bar is fed through the second arm into the mold. Before the first arm has rotated 180 degrees into its end position, the starter bar tail has entered a pinch roll pair inside the machine, so that clamps of the first arm can be opened. The pinch rolls of the caster then are used to control the starter bar to place the head at the correct position into the mold for packing and the beginning of a new casting sequence. The charging car travels toward the rotating frame to be rotated into vertical position to receive the starter bar again after the start of the next cast.

BRIEF DESCRIPTION OF THE DRAWINGS

Other objects and features of the present invention will become apparent from the following detailed description of an embodiment of the invention taken in connection with the accompanying drawings, in which.

DESCRIPTION OF THE PREFERRED EMBODIMENTS

Figure 1:
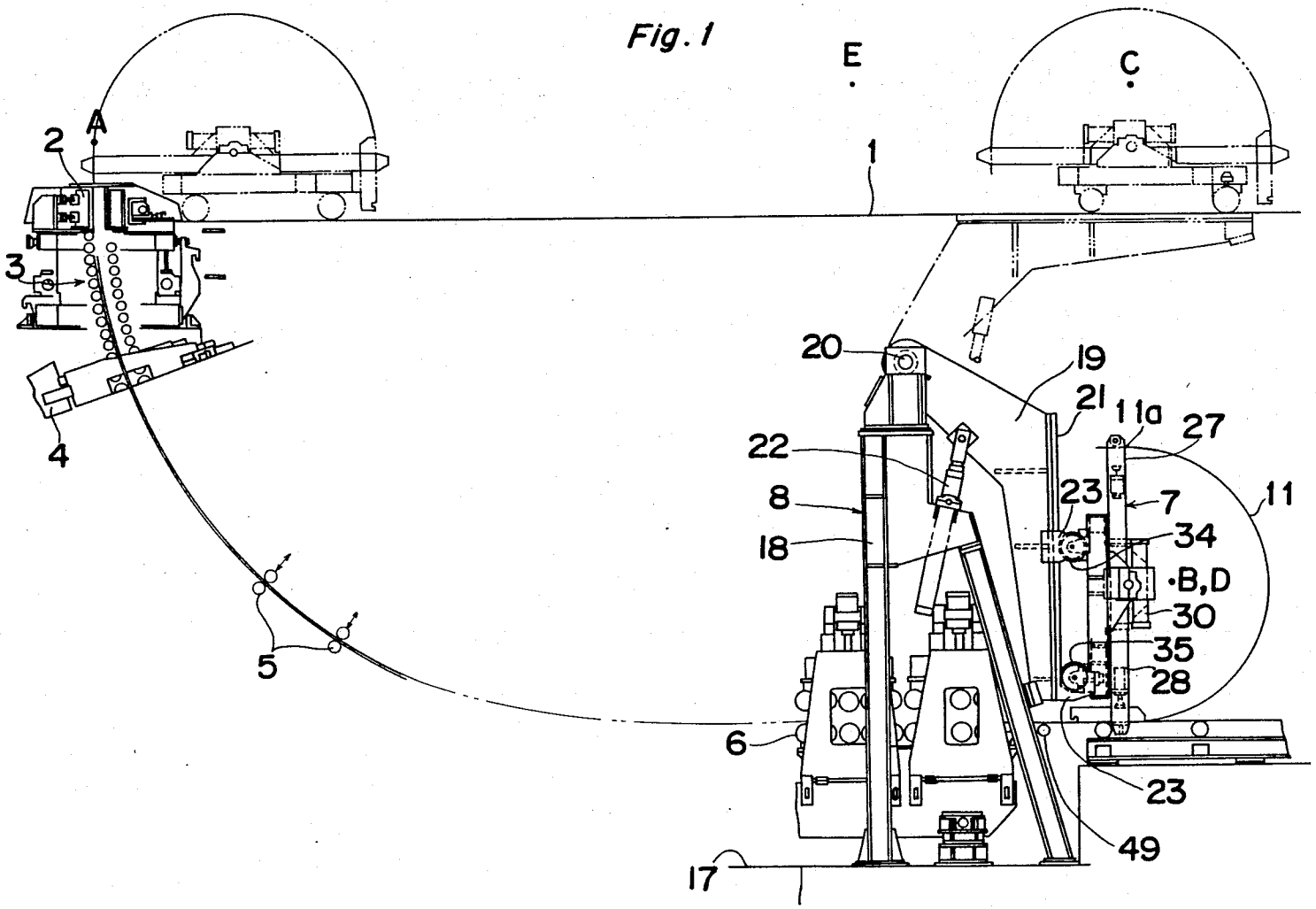
FIG. 1 is a schematic explanatory view of the entire assembly of the continuous casting assembly having a starter bar apparatus embodying the present invention.

In a continuous casting assembly as partially illustrated in FIG. 1, a mold 2 is disposed in a pouring position A on a casting floor 1, and a top roll unit 3 and guide roll units 4 (only one unit being shown in the figure) are disposed in series under the mold 2 to guide a cast strand along a predetermined curved casting line. Moreover, between guide roll units 4 are disposed pinch roll units 5 as will be fully described later, and a withdrawal roll unit 6 is disposed downstream of the pinch roll units 5. Beside the withdrawal roll unit 6 is located a storage position B, in which is disposed a lift device 8 for moving a charging car 7 vertically between the storage position B and a raised position C set on the casting floor 1.

Figure 2:
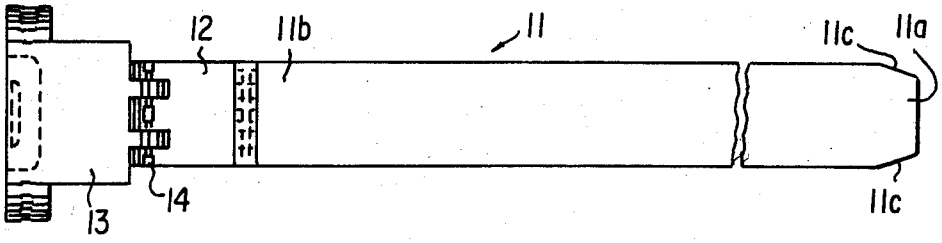
FIG. 2 is a developed plan view of a plate type starter bar used therein.

A plate type starter bar 11, as shown in FIG. 2 is formed by a relatively thin and elongated steel plate, e.g., a high strength steel plate. A fore end portion 11*a* thereof is cut to form cut portions 11*c*. Further, an intermediate block 12 is connected to a rear end portion 11*b* and a starter bar head 13 is connected to the intermediate block 12 with pins 14.

The length of the plate type starter bar 11 is set to a length at which the fore end portion 11*a* reaches the pinch roll units 5 while the starter bar head 13 is set to the proper elevation in the mold 2, permitting the plate type starter bar 11 to be withdrawn by pinch rolls.

Referring to FIG. 1, the lift device 8 disposed in the storage position B is provided with a tower 18 erected on a foundation floor 17, and a pivotable frame 19 herein referred to as a lifting frame is pivotally connected to an upper part of the tower 18 through a shaft 20. The pivotable lifting frame 19 is pivoted between a lowered position D in which running rails 21 of the lifting frame for the charging car 7 assume a vertical state and the raised position C in which the rails 21 assume a horizontal state along the casting floor 1. This movement of the pivotable lifting frame 19 between the lowered position D and the raised position C is performed by the operation of a lift cylinder 22 pivotably mounted to the tower 18. As part of the running rails 21 of the pivotable lifting frame 19 are provided stoppers 23 for supporting front and rear wheels 34 and 35 of the charging car 7. The upper stopper 23 serves to maintain the front wheels 34 in contact with the rail 21. The lower stopper 23 serves to maintain the charging car 7 from moving in a vertical downstream direction.

Figure 3:
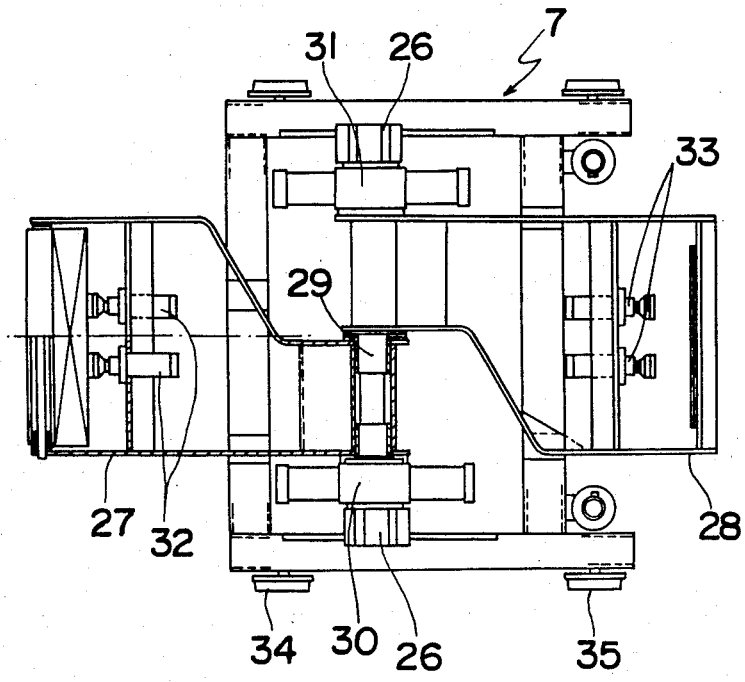
FIG. 3 is a plan view of a charging car used in the invention.
Figure 4:
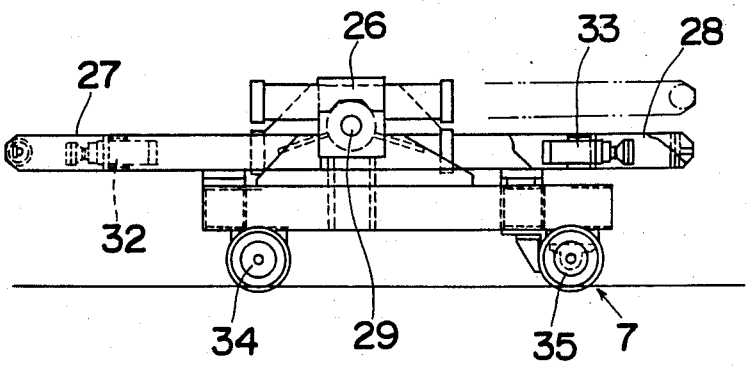
FIG. 4 is a side view of the charging car.

As shown in FIGS. 3 and 4, first and second arms 27, 28 are pivotally connected to bearings 26 of the charging car coaxially through a shaft 29. The first arm 27 is adapted to be swung 180° by a first rotary actuator 30 and the second arm 28 swung 180° by a second rotary actuator 31. The first arm 27 is provided with first clamps 32 for clamping the fore end portion 11*a* of the plate type starter bar 11, while the second arm 28 is provided with second clamps 33 for clamping the intermediate block 12 connected to the rear end portion 11*b* of the plate type starter bar 11. The charging car 7 travels between its raised position C and the pouring position A along rails on the casting floor through its front and rear wheels 34 and 35.

Figure 10:
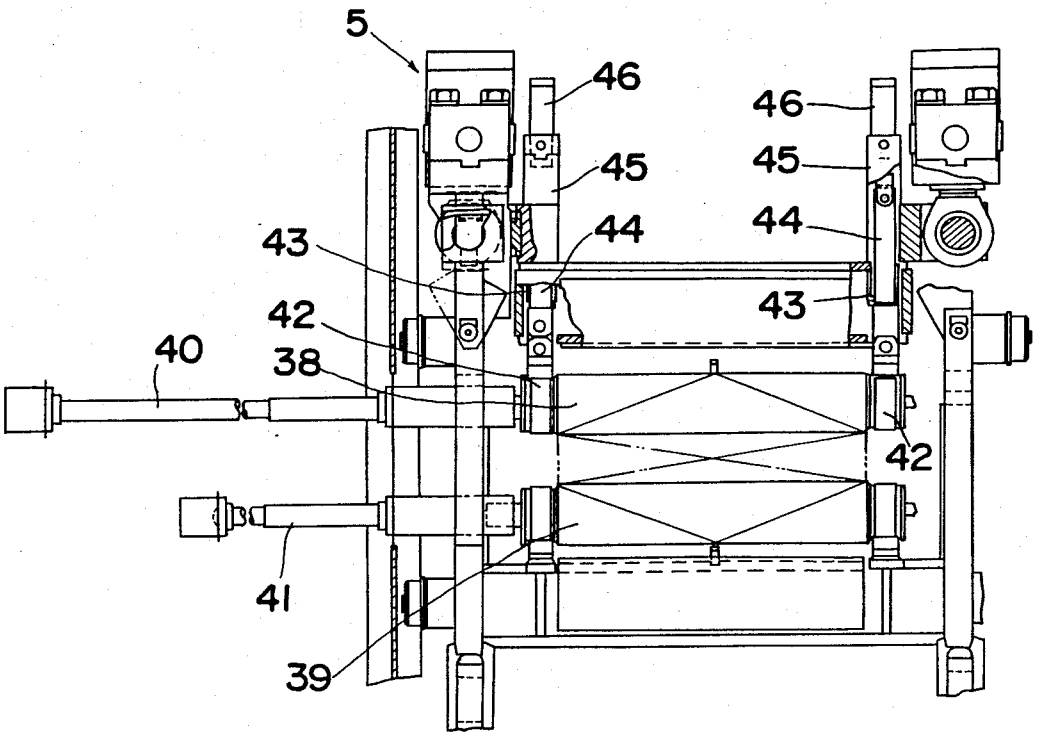
FIG. 10 is a front view of the pinch roll unit.
Figure 9:
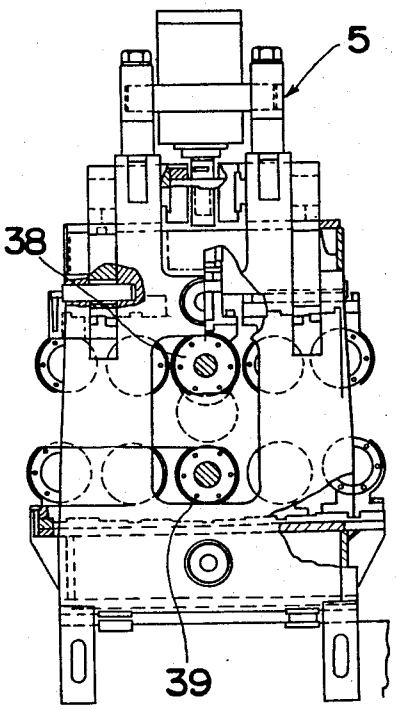
FIG. 9 is a side view of a pinch roll unit suitable for the plate type starter bar.

As shown in FIGS. 9 and 10, the pinch roll unit 5 is constructed so that central rolls 38, 39 are driven by drive shafts 40, 41. Bearing boxes 42 of the upper drive roll 38 are connected to guide shafts 44 which are vertically guided by guide bushes 43 and which are connected to pinch cylinders 46 fixed to cylinder brackets 45. The upper drive roll 38 is moved vertically by operation of the pinch cylinders 46, and at the time of descent, presses the plate type starter bar 11 between it and the lower drive roll 39.

In the pinch roll unit 5, the stroke of the pinch cylinder 46 is made longer than that in the conventional pinch roll unit to lengthen the guide bushes 43, thereby permitting pressure contact for the relatively thin plate type starter bar 11.

The following description is provided regarding the operation of the starter bar apparatus in the continuous casting assembly.

Figure 5:
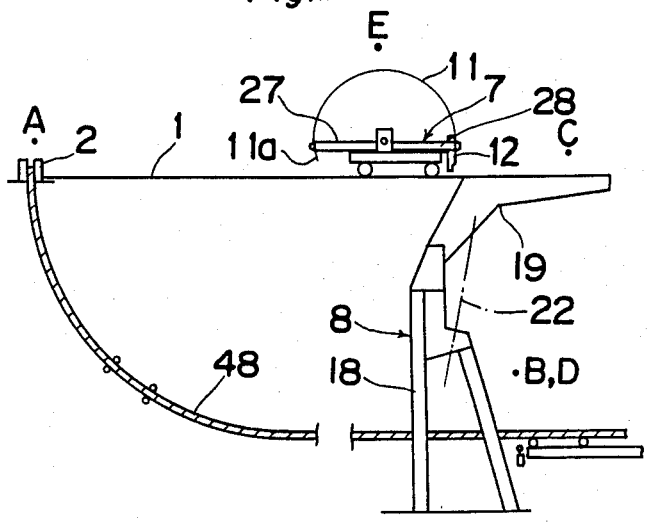
FIG. 5 is a side view showing the plate type starter bar in a stand-by state.
Figure 6:
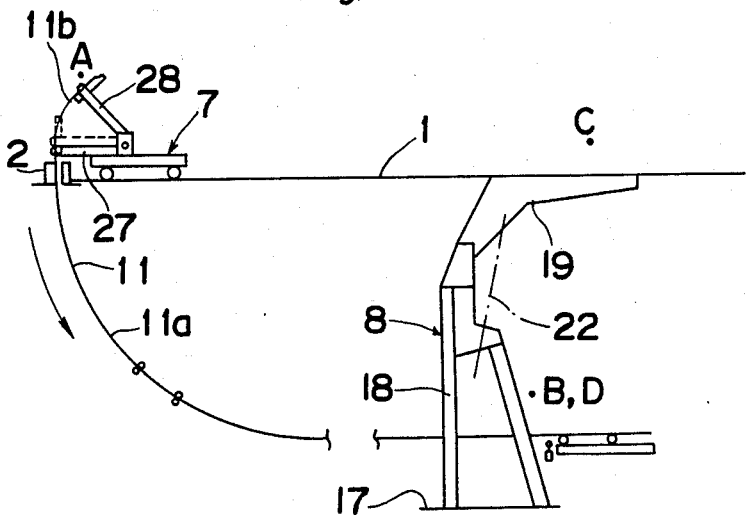
FIG. 6 is a side view showing the plate type starter bar being charged into a mold.

As shown in the FIG. 5, during production of a cast strand 48 in the mold 2 of the continuous casting assembly, the charging car 7 is positioned in a standby position E ahead of the raised position C. The plate type starter bar 11 is clamped at its fore end portion 11*a* by the first clamps 32 of the first arm 27 and at its intermediate block 12 by the second clamps 33. After completion of the previous casting process, the charging car 7 moves to the mold location A as shown in FIG. 6.

Then, by unclamping the fore end portion 11*a* of the plate type starter bar 11 from the first clamps 32 and swinging 180° the second arm 28, the plate type starter bar 11 is charged from its fore end 11*a* side into the mold 2, top roll unit 3, guide roll units 4 and pinch roll units 5. Upon insertion of the fore end portion 11*a* between the pinch roll units 5, the cylinders 46 are operated to hold the fore end portion 11*a* under pressure between the upper and lower drive rolls 38, 39, whereupon the intermediate block 12 of the plate type starter bar 11 is unclamped from the second clamps 33 of the charging car 7. Thereafter, the starter bar head 13 is set at a predetermined height in the mold by operating the drive rolls 38 and 39 and casting is started.

Figure 7:
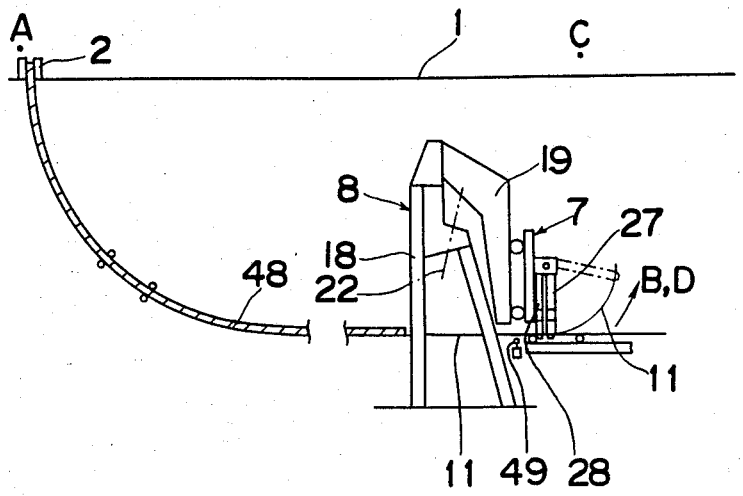
FIG. 7 is a side view showing the plate type starter bar after entering the charging car.

Once the next casting process is started, the leading end portion of the cast strand 48 is coupled to the starter bar head 13 of the plate type starter bar 11 and the cast strip 48 is gradually withdrawn from the mold 2 as the starter bar is withdrawn by the pinch roll units 5. During this period, the charging car 7 moves to its raised position C and stops and stands by on the running rails 21 of the pivotable lifting frame 19 of the lift device 8. The first arm is swung to overlap the second arm 28 by means of the first rotary actuator 30. Then, as shown in FIG. 7, the pivotable lifting frame 19 of the lift device 8 turns to the lowered position D and the charging car 7 is set to the storage position B. When the plate type starter bar 11 is fed to the draw-out roll unit 6 through the guide roll units 4 and pinch roll units 5, the leading end portion 11*a* is clamped by the first clamps 32 of the first arm 27 of the charging car 7.

Thereafter, the first arm 27 is swung upward in synchronism with the speed of the cast strip 48 being withdrawn and the plate type starter bar 11 is guided upward at the predetermined radius of curvature by means of the first arm 27. Once the trailing end portion 11*b* of the plate type starter bar 11 is positioned outside of the withdrawal roll unit 6, the intermediate block 12 coupled to the starter head 13 is clamped by the second clamps 33 of the second arm 28 and the leading end portion of the strand 48 is uncoupled from the starter bar head 13 by means of a separating roll 49, then only the cast strand 48 is delivered continuously from the withdrawal roll unit 6.

Figure 8:
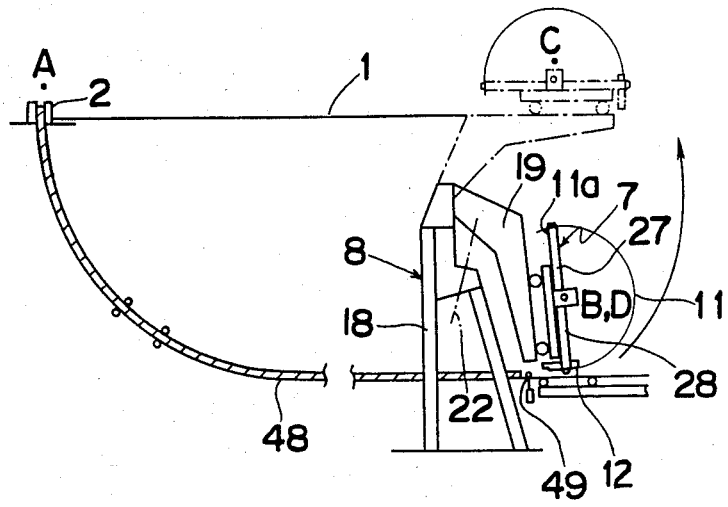
FIG. 8 is a side view showing the plate type starter bar and charging car being swung into the casting floor position.

As shown in FIG. 8, once the plate type starter bar 11 is clamped by the first and second arms 27 and 28, the pivotable lifting frame 19 of the lift device 8 turns to the raised position C and the charging car 7 moves forward from the raised position C to the standby position E on the casting floor 1, where it stands by. Thus, one cycle has been completed.

Although a so-called top charging system wherein the plate type starter bar 11 is charged from above the mold 2 has been described in the above embodiment, there may be adopted a so-called bottom charging system wherein the bar 11 is charged from the bottom side of the mold 2.

Figure 11:
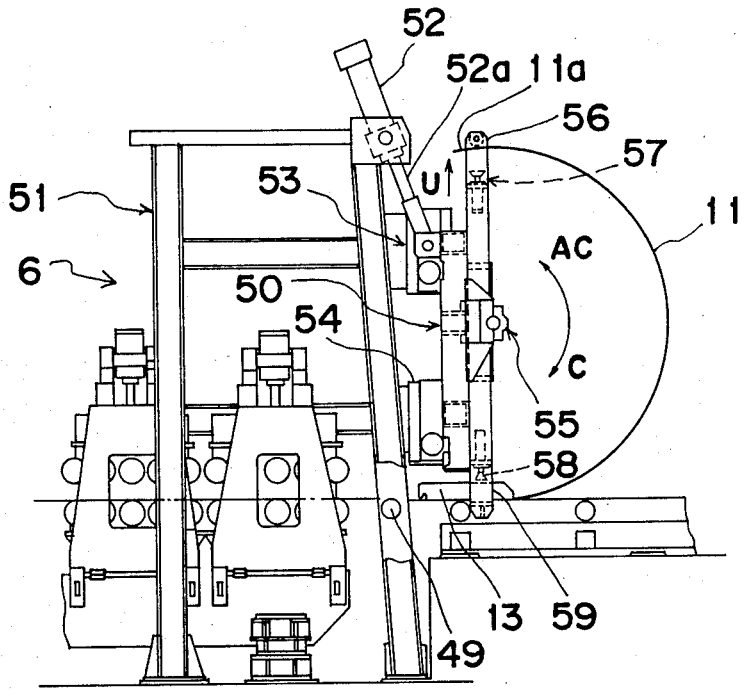
FIG. 11 shows a starter bar handling system for bottom feeding of starter bar.

FIG. 11 shows an example of such bottom charging system. In the embodiment illustrated therein, a charging table 50 is disposed in a vertical plane so as to be movable vertically, in place of the charging car 7 and pivotable stand 19, as is apparent from a comparison with the charging car type shown in FIG. 1. The charging table 50 is connected at an upper part thereof to a piston rod 52*a* of a lift cylinder 52 attached pivotably to an upper part of a tower frame 51 which is constituted using a portal frame. And it is guided vertically movably by two lift guides 53 and 54 mounted up and down on the back side of the tower frame 51. On the charging table 50 is mounted a swing arm 56 adapted to be swung 180° by means of a rotary actuator 55. The swing arm 56 is provided at a fore end thereof with a clamp 57 for clamping the leading end portion 11*a* of the plate type starter bar 11. Further mounted on the charging table 50 is a holding frame 59 which is provided at a fore end (lower end) thereof with a clamp 58 for clamping the starter bar head 13.

For performing a bottom charge, first in the state shown in FIG. 11, the starter bar head 13 is unclamped from the clamp 58 of the holding frame 59 and then the rotary actuator 55 is operated to turn the swing arm 56 in a clockwise direction C, whereby the plate type starter bar 11 is charged from the starter bar head 13 side in a direction opposite the cast strand withdrawal direction, then further fed reversely by withdrawal roll units 6 and pinch roll units 5 and inserted from the bottom of the mold.

For recovering the plate type starter bar 11, the swing arm 56 is allowed to stand by in the lowest position and the fore end portion 11*a* of the plate type starter bar 11 being delivered is clamped by the clamp 57, then the swing arm 56 is turned in a counterclockwise direction AC at an angular velocity matching the withdrawal speed to raise the plate type starter bar 11. When the swing arm 56 has turned 180° and the intermediate block 12 has been withdrawn up to the position of the holding frame 59, intermediate block 12 is held by the clamp 58 and at the same the separating roll 49 is pushed up to separate the head from the leading end of the cast strip. Then, the lift cylinder 52 is operated in a rising direction U to raise the entirety of the charging table 50, whereby the starter bar head 13 is moved to the raised position so as to not interfere with the cast strip being drawn out. This embodiment is advantageous over the charging car type shown in FIG. 1 in that the structure can be simplified.

Although the present invention has been described in its preferred embodiments, it is to be understood that the invention is not limited thereto and that such modifications and alterations as can be easily effected by those skilled in the art are included in the invention within the scope of the technical concept described in the scope of the appended claims.

What is claimed as new and desired to be secured by Letters Patent of the United States is:

1. A starter bar apparatus in a continuous casting assembly, comprising:

a plate type starter bar with a starter bar head attached to a rear end portion thereof, said plate type starter bar being formed of a relatively thin plate; and a starter bar handling device, said starter bar handling device having first arm means for clamping a fore end portion of the plate type starter bar when withdrawn from a roll unit and for swinging said starter bar upward at a predetermined radius of curvature in synchronism with a withdrawing speed and second arm means for clamping a rear end portion of the plate type starter bar as swung by the first arm means.

2. A starter bar apparatus in a continuous casting assembly utilizing a mold comprising:

a plate type starter bar with a starter bar head attached to a rear end portion thereof, said plate type starter bar being formed of a relatively thin plate;

a starter bar charging car, said starter bar charging car having first arm means for clamping a fore end portion of the plate type starter bar when withdrawn from a roll unit and for swinging said starter bar upward along a predetermined curvature in synchronism with a withdrawing speed and second arm means for clamping a rear end portion of the plate type starter bar as swung by the first arm means;

a lift device for moving said starter bar charging car vertically between a storage position and a casting floor position; and means for controlling said charging car so that when raised to the casting floor position by said lift device, the charging car moves to a pouring position, whereupon a leading end portion of said plate type starter bar is unclamped from said first arm means, and the plate type starter bar is then charged into said mold by a swinging motion of said second arm means.

* * * * *